US010668734B2

(12) United States Patent
Yoshii

(10) Patent No.: US 10,668,734 B2
(45) Date of Patent: Jun. 2, 2020

(54) INK CONTAINER AND IMAGE FORMING APPARATUS

(71) Applicant: KYOCERA Document Solutions Inc., Osaka (JP)

(72) Inventor: Tatsuhiko Yoshii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/281,918

(22) Filed: Feb. 21, 2019

(65) Prior Publication Data

US 2020/0139718 A1 May 7, 2020

(30) Foreign Application Priority Data

Nov. 7, 2018 (JP) ..... 2018-209743

(51) Int. Cl.

| | |
|---|---|
| ***B41J 2/175*** | (2006.01) |
| ***B65D 77/20*** | (2006.01) |
| ***B65D 77/30*** | (2006.01) |
| ***B41J 2/03*** | (2006.01) |

(52) U.S. Cl.

CPC ..... *B41J 2/17513* (2013.01); *B41J 2/03* (2013.01); *B41J 2/1754* (2013.01); *B41J 2/17523* (2013.01); *B41J 2/17533* (2013.01); *B41J 2/17553* (2013.01); *B65D 77/2028* (2013.01); *B65D 77/2032* (2013.01); *B65D 77/30* (2013.01); *B41J 2002/17516* (2013.01)

(58) Field of Classification Search

CPC ..... B41J 2/17503; B41J 2/17513; B41J 2/17523; B41J 2/17533; B41J 2/1754; B41J 2/17553; B41J 2002/17516; B65D 77/30; B65D 77/2028; B65D 77/2032

See application file for complete search history.

(56) References Cited

U.S. PATENT DOCUMENTS

| | | | | |
|---|---|---|---|---|
| 5,231,416 A * | 7/1993 | Terasawa | ..... | B41J 2/16505 206/723 |
| 6,286,946 B1 * | 9/2001 | Umemura | ..... | B41J 2/17533 347/86 |
| 6,676,251 B1 * | 1/2004 | Kamp | ..... | B41J 2/17513 347/86 |

(Continued)

FOREIGN PATENT DOCUMENTS

| | | |
|---|---|---|
| JP | 2014028480 A | 2/2014 |
| JP | 2014213565 A | 11/2014 |
| WO | 2017014779 A1 | 1/2017 |

OTHER PUBLICATIONS

The extended European search report issued by the European Patent Office dated Jun. 26, 2019, which corresponds to European Patent Application No. 19156357.6-1019 and is related to U.S. Appl. No. 16/281,918.

*Primary Examiner* — Anh T Vo

(74) *Attorney, Agent, or Firm* — Studebaker & Brackett PC

(57) ABSTRACT

The ink container includes an ink pack, a paper case and a cover. The ink pack is configured to store ink. The paper case is configured to store the ink pack and to have a shape elongated in one direction. The cover is bonded to an end portion in the one direction of the case. A protection rib is protruded on an outer circumferential face of the cover. The protection rib covers, from an outside in the one direction, a bonded portion of the end portion of the case and the cover.

14 Claims, 10 Drawing Sheets

(56) References Cited

U.S. PATENT DOCUMENTS

| | | | | |
|---|---|---|---|---|
| 8,960,872 | B2 | 2/2015 | Maeshima | |
| 9,827,775 | B2 | 11/2017 | Arimura | |
| 2005/0099471 | A1* | 5/2005 | Mukai | B41J 2/17533 347/84 |
| 2010/0073442 | A1* | 3/2010 | Akiyama | B41J 2/17509 347/86 |

* cited by examiner

INK CONTAINER AND IMAGE FORMING APPARATUS

INCORPORATION BY REFERENCE

This application is based on and claims the benefit of priority from Japanese patent application No. 2018-209743, filed on Nov. 7, 2018, which is incorporated by reference in its entirety.

BACKGROUND

The present disclosure relates to an ink container and an image forming apparatus including the ink container.

An inkjet type image forming apparatus forms an image on a recording medium by discharging ink from a recording head on the recording medium. The ink used for forming the image is usually supplied to the recording head from an ink container. The ink container is usually detachably attached to an attachment part provided in the image forming apparatus.

For example, the ink container includes an ink pack storing the ink, a case storing the ink pack and a cover fixed to an end portion of the case.

SUMMARY

In accordance with an aspect of the present disclosure, an ink container includes an ink pack, a paper case and a cover. The ink pack is configured to store ink. The paper case is configured to store the ink pack and to have a shape elongated in one direction. The cover is bonded to an end portion in the one direction of the case. A protection rib is protruded on an outer circumferential face of the cover. The protection rib covers, from an outside in the one direction, a bonded portion of the end portion of the case and the cover.

In accordance with an aspect of the present disclosure, an image forming apparatus includes the ink container and an attachment part to which the ink container is detachably attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, an entire structure of an image forming apparatus 1 will be described.

Figure 1:
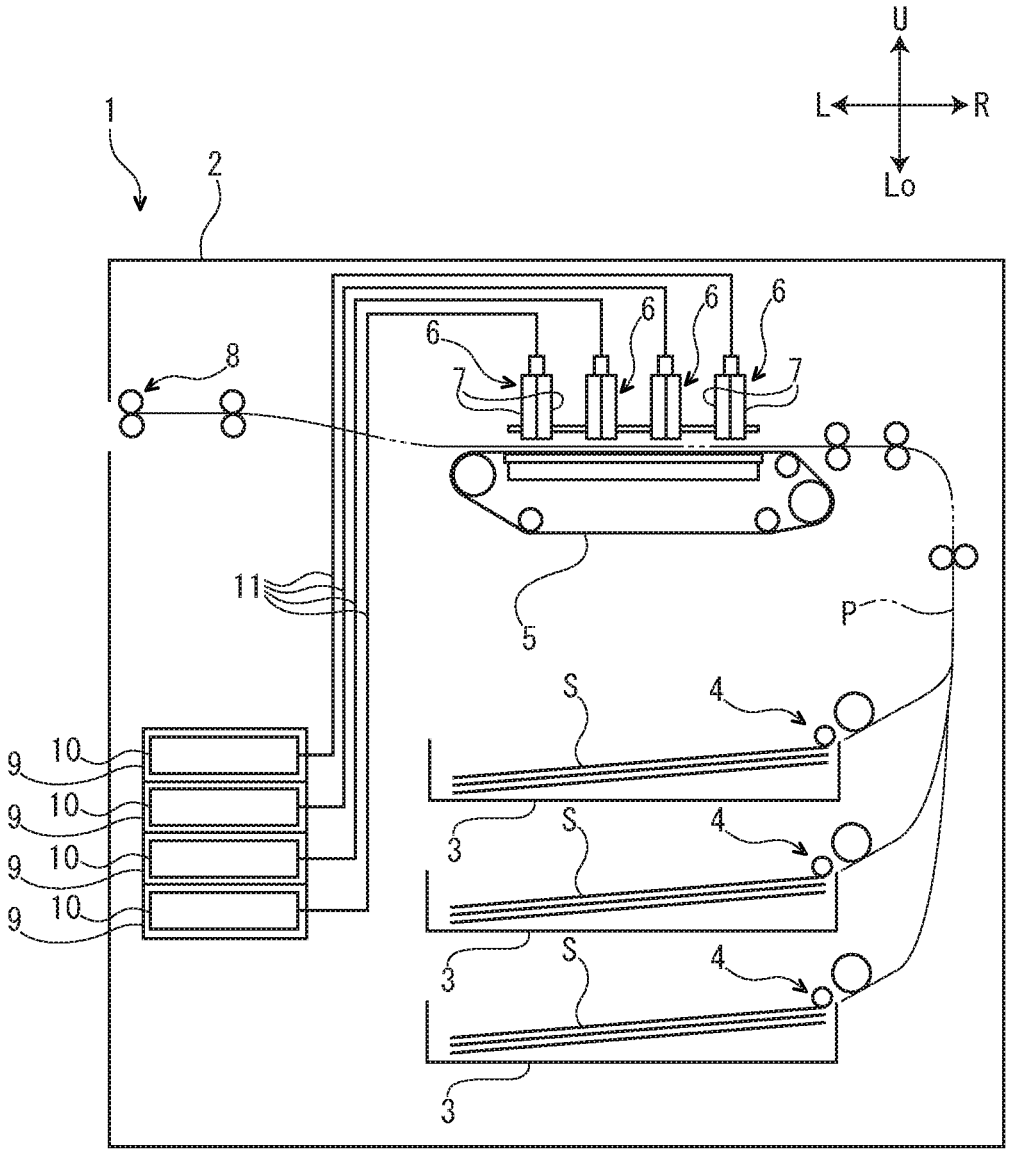
FIG. 1 is a schematic front view showing an image forming apparatus according to an embodiment of the present disclosure.

Hereinafter, for convenience of explanation, a near side of a paper surface of FIG. 1 is defined as a front side of the image forming apparatus 1. Arrows Fr, Rr, L, R, U and Lo suitably marked in each figure respectively indicate a front side, a rear side, a left side, a right side, an upper side and a lower side of the image forming apparatus 1. In the present embodiment, a front-and-rear direction is an example of one direction, an upper-and-lower direction is an example of a direction perpendicular to the one direction, and a left-and-right direction is an example of a direction perpendicular to the one direction and the upper-and-lower direction.

With reference to FIG. 1, the image forming apparatus 1 is an inkjet type color printer, for example. The image forming apparatus 1 includes a box-shaped apparatus main body 2. In a lower portion of the apparatus main body 2, a plurality of sheet feeding cassettes 3 is stored. Each sheet feeding cassette 3 stores a sheet S (an example of a recording medium).

Inside the apparatus main body 2, a conveyance path P for the sheet S is provided. At an upstream end portion of the conveyance path P, a plurality of sheet feeding parts 4 is provided. At a midstream portion of the conveyance path P, a conveyance belt 5 and four line heads 6 are provided. The respective line heads 6 correspond to black, cyan, magenta and yellow. Each line head 6 includes a plurality of recording heads 7. At a downstream end portion of the conveyance path P, a sheet ejecting part 8 is provided.

In a left lower portion of the apparatus main body 2, four attachment parts 9 are provided. To each attachment part 9, one of four ink containers 10 is detachably attached. The respective ink containers 10 store inks of black, cyan, magenta and yellow. Each ink container 10 is connected to the corresponding recording head 7 of the corresponding line head 6 via one of four pipes 11.

Next, an operation of the image forming apparatus 1 having the above described configuration will be described.

First, the sheet S is fed from the sheet feeding cassette 3 by the sheet feeding part 4. The fed sheet S is conveyed to a downstream side along the conveyance path P and sucked on an upper face of the conveyance belt 5. The recording head 7 of the line head 6 discharges the ink supplied from the ink container 10, to the sheet S sucked on the upper face of the conveyance belt 5. Thereby, a color image is formed on the sheet S. The sheet S on which the color image is formed is further conveyed to the downstream side along the conveyance path P and then ejected by the sheet ejecting part 8 outside the apparatus main body 2.

Next, each attachment part 9 will be described in detail.

Figure 2:
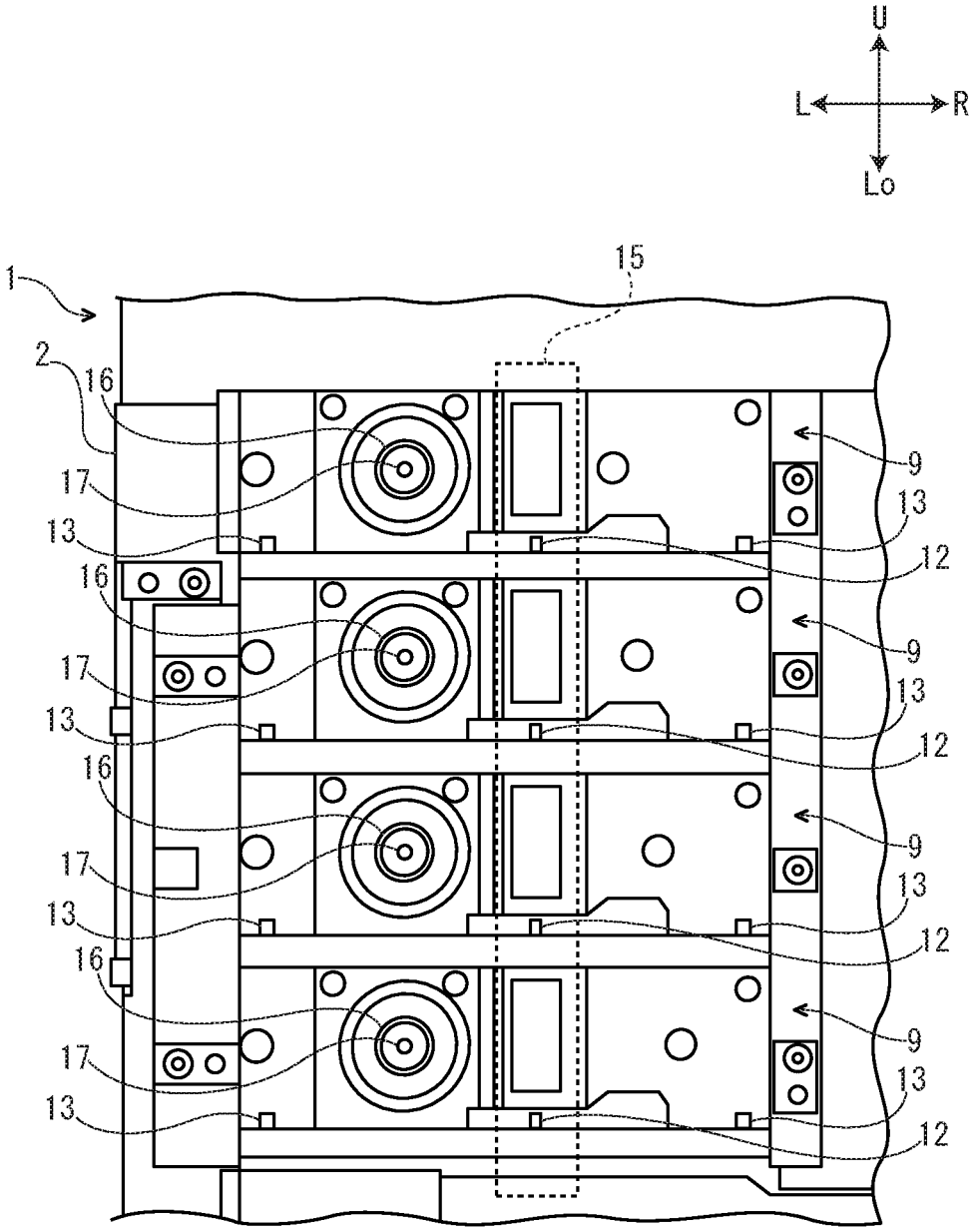
FIG. 2 is a front view showing each attachment part and its periphery according to the embodiment of the present disclosure.

With reference to FIG. 2, each attachment part 9 extends along the front-and-rear direction (a depth direction of a paper surface of FIG. 2). A front end portion of each attachment part 9 is opened. The front end portion of each attachment part 9 is covered by a front cover (not shown).

On a rear portion of a bottom face of each attachment part 9, a pin 12 is protruded. On the rear portion of the bottom face of each attachment part 9, bosses 13 are protruded at both sides in the left-and-right direction of the pin 12. At the rear side of each attachment part 9, a communication board 15 is provided. On a rear face of each attachment part 9, a cylindrical supply port 16 is provided. At a center portion of the supply port 16, a needle 17 is provided.

Next, each ink container 10 will be described in detail.

Figure 3:
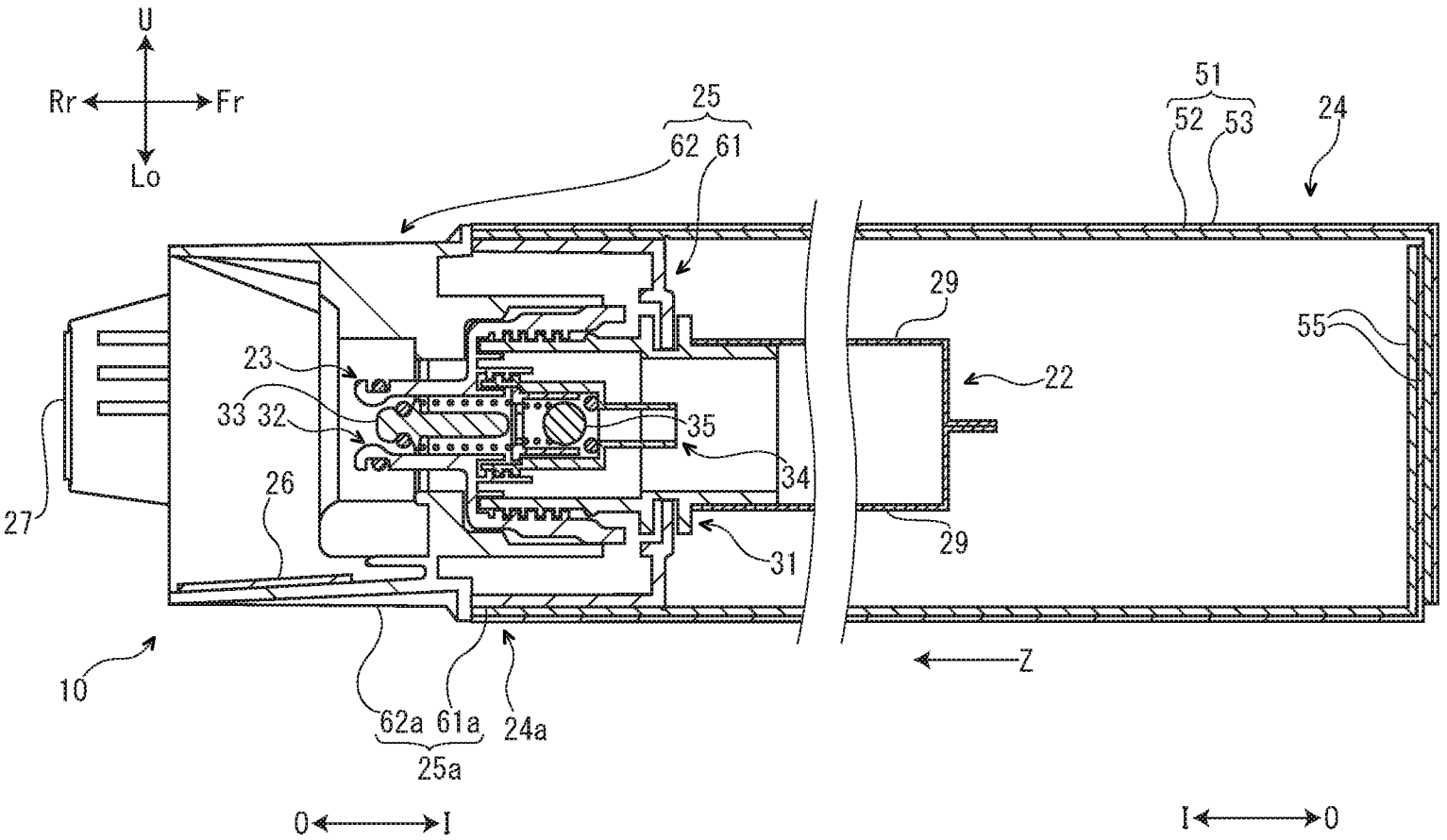
FIG. 3 is a sectional view showing an ink container according to the embodiment of the present disclosure.

An arrow O suitably marked in each figure subsequent to FIG. 3 indicates an outside in the front-and-rear direction of each ink container 10 (a side separate from a center portion in the front-and-rear direction of each ink container 10), and an arrow I suitably marked in each figure subsequent to FIG. 3 indicates an inside in the front-and-rear direction of each ink container 10 (a side close to the center portion in the front-and-rear direction of each ink container 10). An arrow Z suitably marked in each figure subsequent to FIG. 3 indicates an attachment direction in which each ink container 10 is attached to the corresponding attachment part 9 (a direction from the front side to the rear side, in the present embodiment).

Figure 4:
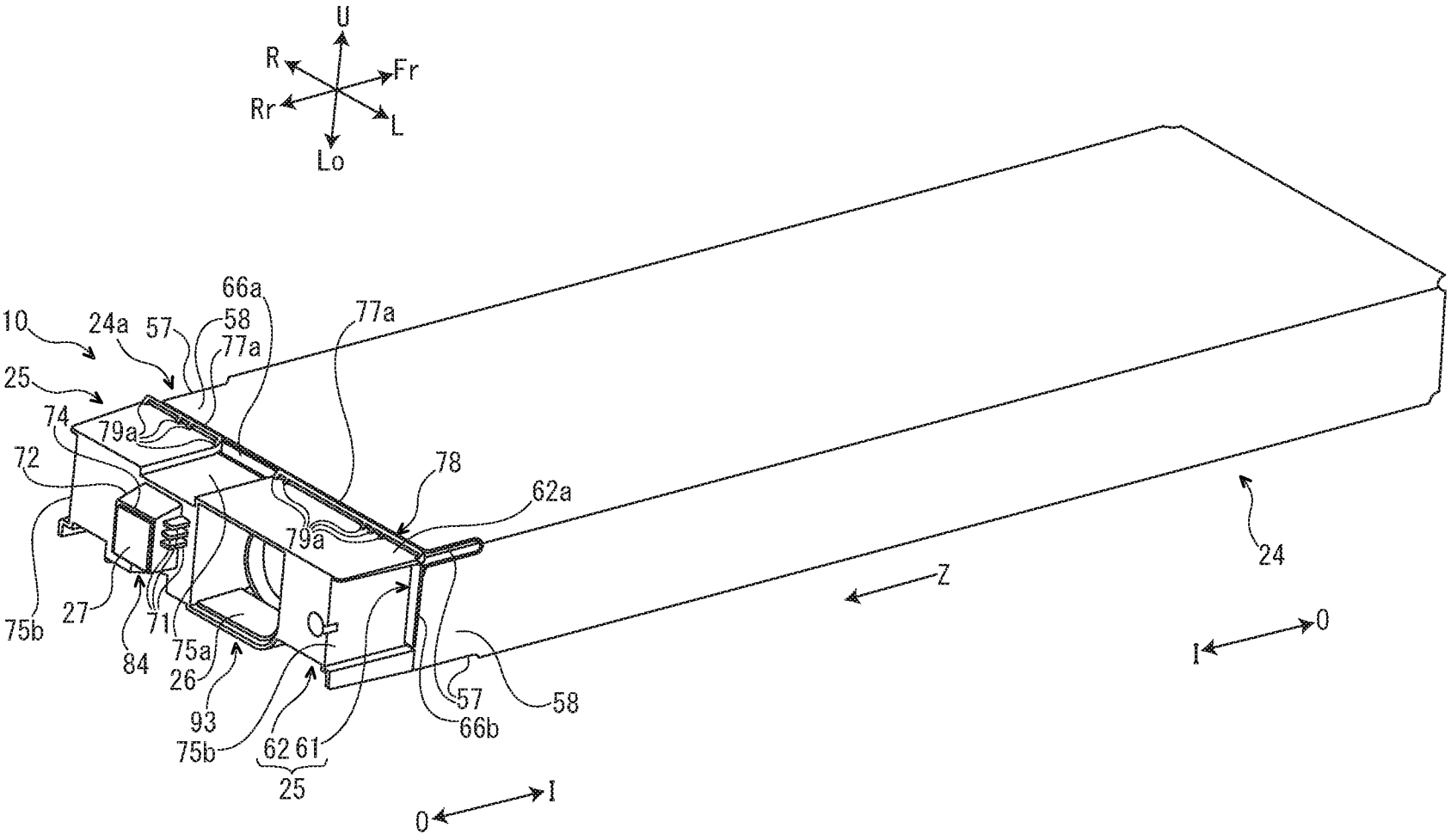
FIG. 4 is a perspective view showing the ink container according to the embodiment of the present disclosure.

With reference to FIG. 3 and FIG. 4, each ink container 10 includes an ink pack 22, a spout 23 attached to a rear end portion (an end portion in the front-and-rear direction) of the ink pack 22, a case 24 storing the ink pack 22, a cover 25 covering a rear end portion 24*a* (an end portion in the front-and-rear direction) of the case 24, a liquid absorbing sheet 26 and an IC tag 27 which are fixed to the cover 25. Hereinafter, the above components of the ink container 10 will be explained in the above order.

First, the ink pack 22 of each ink container 10 will be described.

With reference to FIG. 3, the ink pack 22 of each ink container 10 has a shape elongated in the front-and-rear direction. The ink pack 22 is formed by welding a plural of film sheets 29, and has a bag like shape. Each film sheet 29 is formed by laminating resin material and metal material, and has flexibility. In an inner space of the ink pack 22, the ink (not shown) is stored.

Next, the spout 23 of each ink container 10 will be described.

Figure 5:
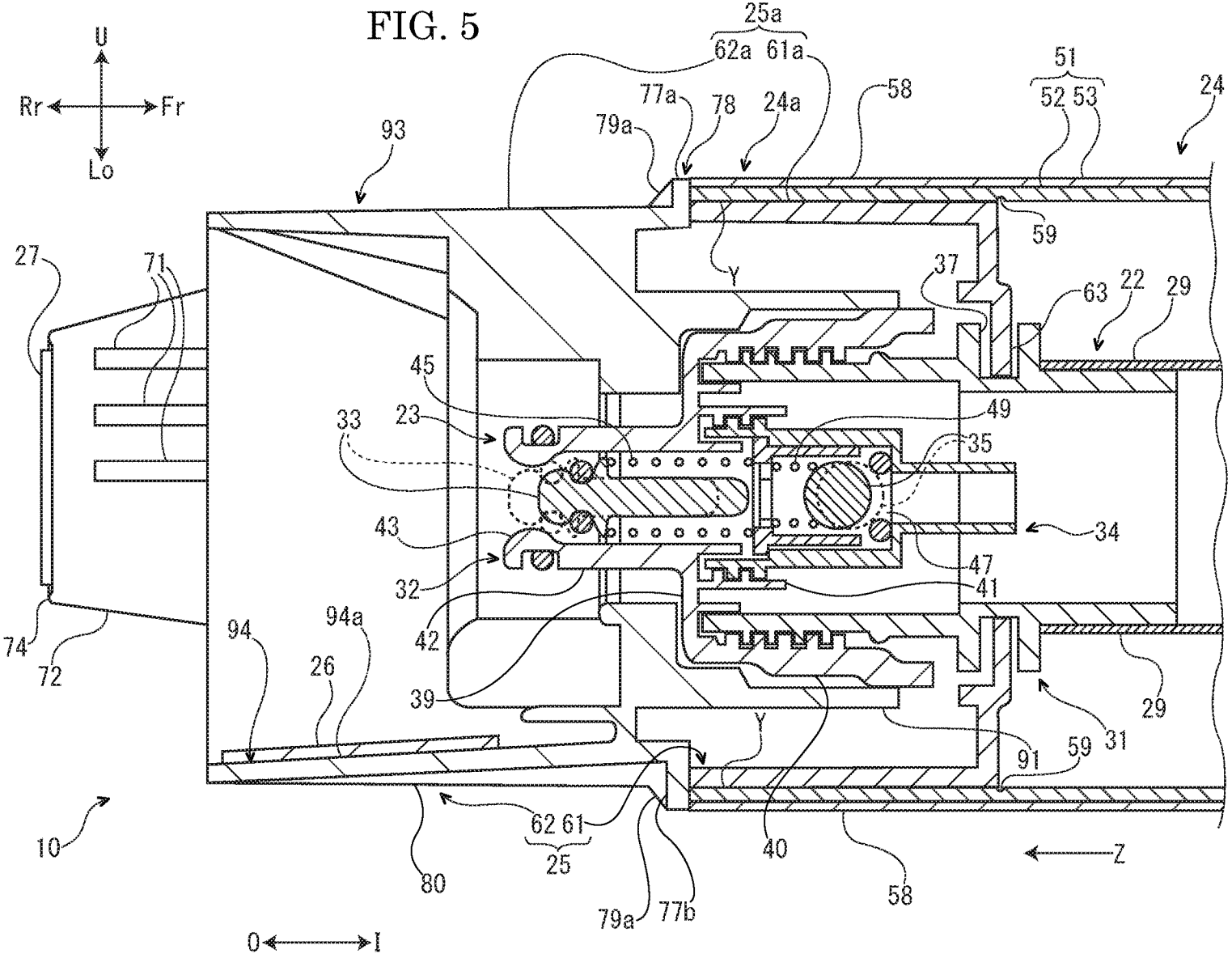
FIG. 5 is a sectional view showing a rear portion of the ink container according to the embodiment of the present disclosure.

With reference to FIG. 5, the spout 23 of each ink container 10 includes a spout main body 31, a cap 32 attached to the spout main body 31, a first valve body 33 stored in the cap 32, a cylindrical body 34 attached to the cap 32 and a second valve body 35 stored in the cylindrical body 34.

The spout main body 31 of the spout 23 has a cylindrical shape. A front end portion of the spout main body 31 is communicated with the inner space of the ink pack 22. An outer circumferential face of the front end portion of the spout main body 31 is welded to the rear end portion of the ink pack 22. On an outer circumferential face of a front portion of the spout main body 31, a restriction groove 37 is provided.

The cap 32 of the spout 23 includes an annular base part 39, an outer cylindrical part 40, an inner cylindrical part 41 and a discharge cylindrical part 42. The outer cylindrical part 40 extends from an outer end portion in a radial direction of the base part 39 to the front side (the inside in the front-and-rear direction). The inner cylindrical part 41 extends from an inner portion in the radial direction of the base part 39 to the front side (the inside in the front-and-rear direction). The discharge cylindrical part 42 extends from an inner end portion in the radial direction of the base part 39 to the rear side (the outside in the front-and-rear direction). An inner circumferential face of the outer cylindrical part 40 is meshed with an outer circumferential face of a rear end portion of the spout main body 31. At a rear end portion of the discharge cylindrical part 42, a discharge port 43 (hereinafter, called "the discharge port 43 of the spout 23") is provided.

The first valve body 33 of the spout 23 is movable in the front-and-rear direction between a first opening position (refer to a solid line in FIG. 5) where the first valve body 33 opens the discharge port 43 of the spout 23 and a first closing position (refer to a dotted line in FIG. 5) where the first valve body 33 closes the discharge port 43 of the spout 23. The first valve body 33 is biased to the first closing position (refer to the dotted line in FIG. 5) by a first spring 45.

The cylindrical body 34 of the spout 23 has a cylindrical shape. The cylindrical body 34 is stored in the spout main body 31. An outer circumferential face of a rear end portion of the cylindrical body 34 is meshed with an inner circumferential face of the inner cylindrical part 41 of the cap 32. Inside the cylindrical body 34, a communication port 47 (hereinafter, called "the communication port 47 of the spout 23") is provided.

The second valve body 35 of the spout 23 is movable in the front-and-rear direction between a second opening position (refer to a solid line in FIG. 5) where the second valve body 35 opens the communication port 47 of the spout 23 and a second closing position (refer to a dotted line in FIG. 5) where the second valve body 35 closes the communication port 47 of the spout 23. The second valve body 35 is biased to the second closing position (refer to the dotted line in FIG. 5) by a second spring 49.

Next, the case 24 of each ink container 10 will be described.

With reference to FIG. 3 and FIG. 4, the case 24 of each ink container 10 has a square tube shape elongated in the front-and-rear direction. The case 24 is formed by a sheet of paper 51. That is, the case 24 is formed by paper. The paper 51 includes a corrugated cardboard layer 52 and a coated cardboard layer 53 covering a surface of the corrugated cardboard layer 52. The corrugated cardboard layer 52 is composed of single-faced corrugated cardboard or double-faced corrugated cardboard, for example. The coated cardboard layer 53 is composed of white-coated cardboard, for example.

At a front end portion of the case 24, a pair of closing plates 55 is provided. The respective closing plates 55 are folded from an upper face and a lower face of the case 24. The closing plates 55 are overlapped with each other to close the front end portion of the case 24.

Figure 6:
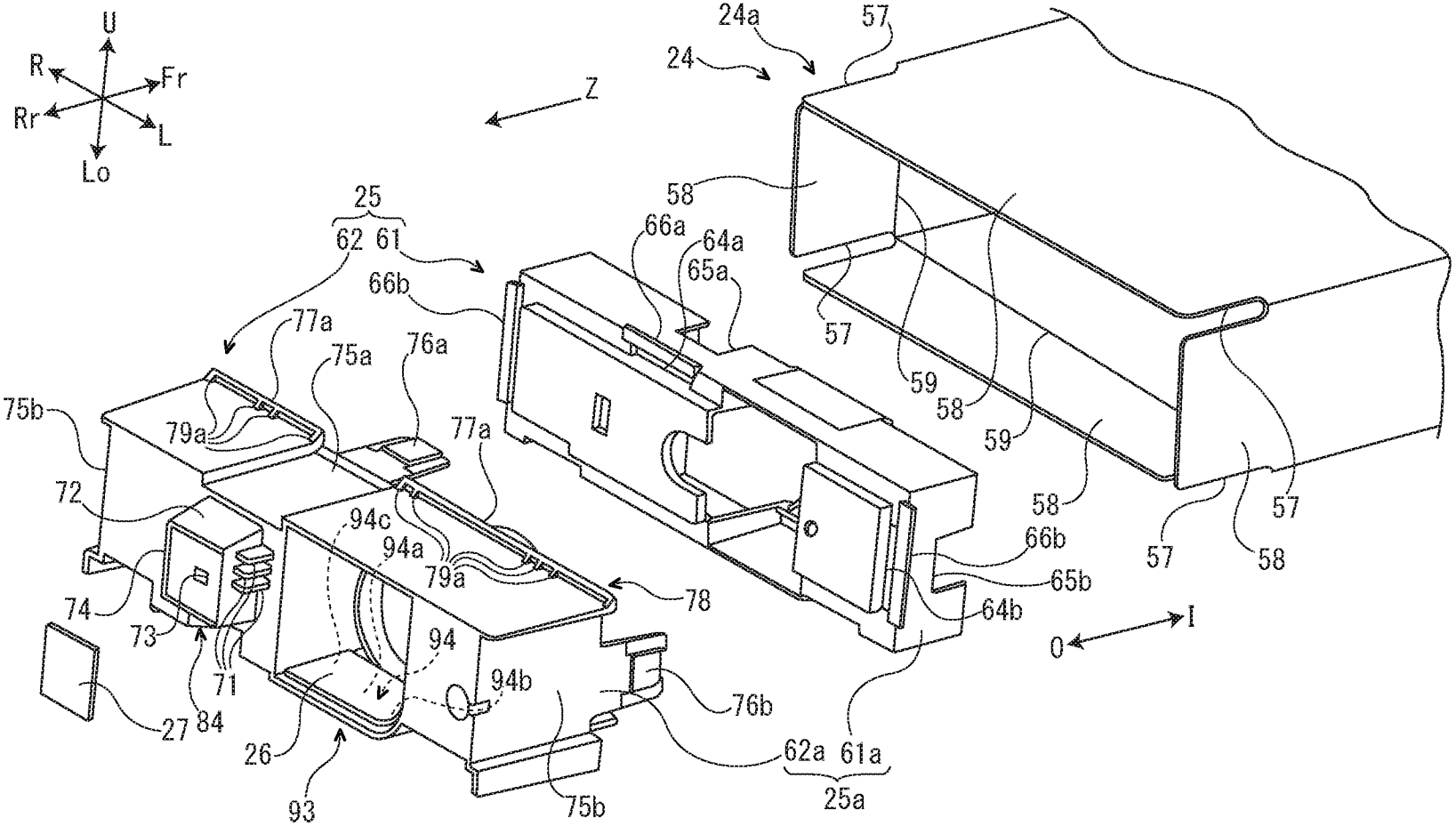
FIG. 6 is a disassembled perspective view showing a case, a cover, a liquid absorbing sheet and an IC tag, viewed from a left upper side, according to the embodiment of the present disclosure.
Figure 7:
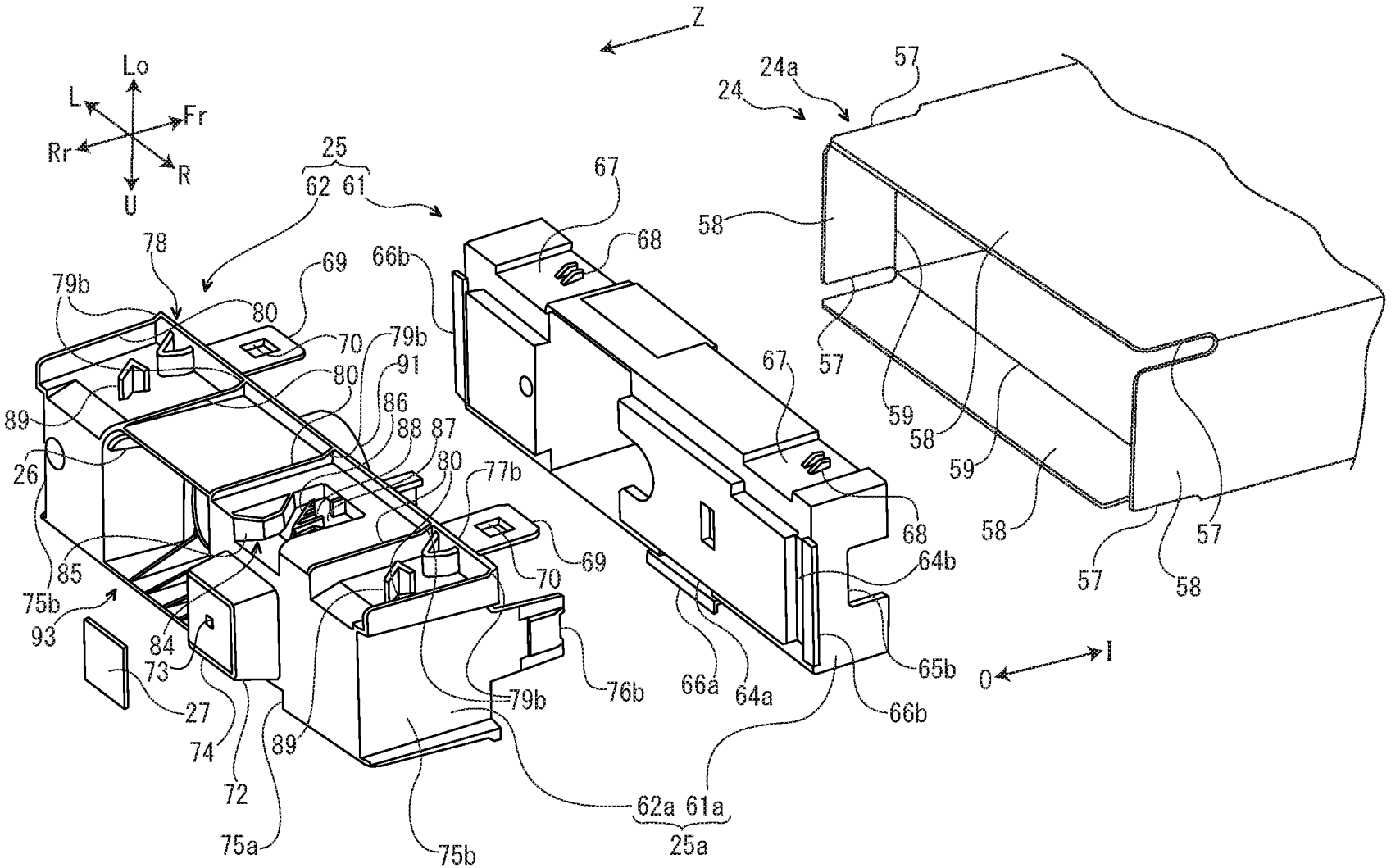
FIG. 7 is a disassembled perspective view showing the case, the cover, the liquid absorbing sheet and the IC tag, viewed from a right lower side, according to the embodiment of the present disclosure.

With reference to FIG. 6 and FIG. 7, the rear end portion 24*a* (the end portion in the front-and-rear direction) of the case 24 is opened. At each of four corner portions of the rear end portion 24*a* of the case 24, a slit 57 is provided. Each slit 57 has a shape elongated in the front-and-rear direction. At the rear end portion 24*a* of the case 24, four flaps 58 are provided between the adjacent slits 57. On an inside face of a front end portion (an end portion at the inside in the front-and-rear direction) of each flap 58, a folding line 59 is provided along the left-and-right direction or the upper-and-lower direction.

Next, the cover 25 of each ink container 10 will be described.

With reference to FIG. 3 and FIG. 4, the cover 25 of each ink container 10 has a square frame shape. The cover 25 includes an inner cover part 61 and an outer cover part 62 attached to the inner cover part 61.

With reference to FIG. 5 to FIG. 7, the inner cover part 61 of the cover 25 has a square frame shape. An outer circumferential face 61*a* (an upper face, a lower face, a left face and a right face) of the inner cover part 61 is bonded to inside faces of the flaps 58 of the case 24. Thereby, the inner cover part 61 is fixed to the rear end portion 24*a* of the case 24.

With reference to FIG. 5, on a front face (a face at the inside in the front-and-rear direction) of the inner cover part 61, a restriction frame 63 is provided. The restriction frame 63 is engaged with the restriction groove 37 provided in the spout main body 31 of the spout 23. This restricts displacement of the spout 23 in the upper-and-lower direction and in the front-and-rear direction with respect to the inner cover part 61.

With reference to FIG. 6 and FIG. 7, on an upper portion of a rear face (a face at the outside in the front-and-rear direction) of the inner cover part 61, a through hole 64*a* is provided. On both side portions in the left-and-right direction of the rear face of the inner cover part 61, through holes 64*b* are provided.

At a front portion of the upper face of the inner cover part 61, a fitting groove 65*a* (an example of a first fitting part) is provided. At front portions of the left face and the right face of the inner cover part 61, fitting grooves 65*b* (an example of the first fitting part) are provided. Each of the fitting grooves 65*a* and 65*b* is recessed from a front end portion (an end portion at the inside in the front-and-rear direction) of the inner cover part 61 to the rear side.

On a rear end portion (an end portion at the outside in the front-and-rear direction) of the upper face of the inner cover part 61, a first rib 66*a* is protruded so as to be overlapped with the through hole 64*a* and the fitting groove 65*a* in the left-and-right direction. The first rib 66*a* extends along the left-and-right direction. On rear end portions (end portions at the outside in the front-and-rear direction) of the left face and the right face of the inner cover part 61, first ribs 66*b* are protruded so as to be overlapped with the through holes 64*b* and the fitting grooves 65*b* in the upper-and-lower direction. Each first rib 66*b* extends along the upper-and-lower direction.

On the lower face of the inner cover part 61, left and right depressions 67 are provided. On each depression 67, a fitting projection 68 is protruded.

With reference to FIG. 5 to FIG. 7, the outer cover part 62 of the cover 25 is formed separately from the inner cover part 61. The outer cover part 62 has a square frame shape. The outer cover part 62 covers the rear side (the outside in the front-and-rear direction) of the inner cover part 61. An outer circumferential face 62*a* (an upper face, a lower face, a left face and a right face) of the outer cover part 62 constitutes an outer circumferential face 25*a* of the cover 25 together with the outer circumferential face 61*a* (the upper face, the lower face, the left face and the right face) of the inner cover part 61.

With reference to FIG. 7, on a lower portion of a front face (a face at the inside in the front-and-rear direction) of the outer cover part 62, left and right protruding pieces 69 are protruded. Each protruding piece 69 is engaged with each depression 67 of the inner cover part 61. Each protruding piece 69 has a fitting hole 70. Into the fitting hole 70, the fitting projection 68 provided on each depression 67 of the inner cover part 61 is fitted.

With reference to FIG. 6, on a center portion of a rear face (a face at the outside in the front-and-rear direction) of the outer cover part 62, three connection ribs 71 are protruded. The connection ribs 71 are aligned at intervals in the upper-and-lower direction. On a right side portion of the rear face of the outer cover part 62, a pedestal part 72 to which the IC tag 27 (described later in detail) is fixed is protruded. A left side face of the pedestal part 72 is connected to the connection ribs 71. At a center portion of a rear face (a face at the outside in the front-and-rear direction) of the pedestal part 72, a square small groove 73 is provided. At an outer edge portion of the rear face of the pedestal part 72, an approximately U-shaped guide rib 74 is provided.

Figure 8:
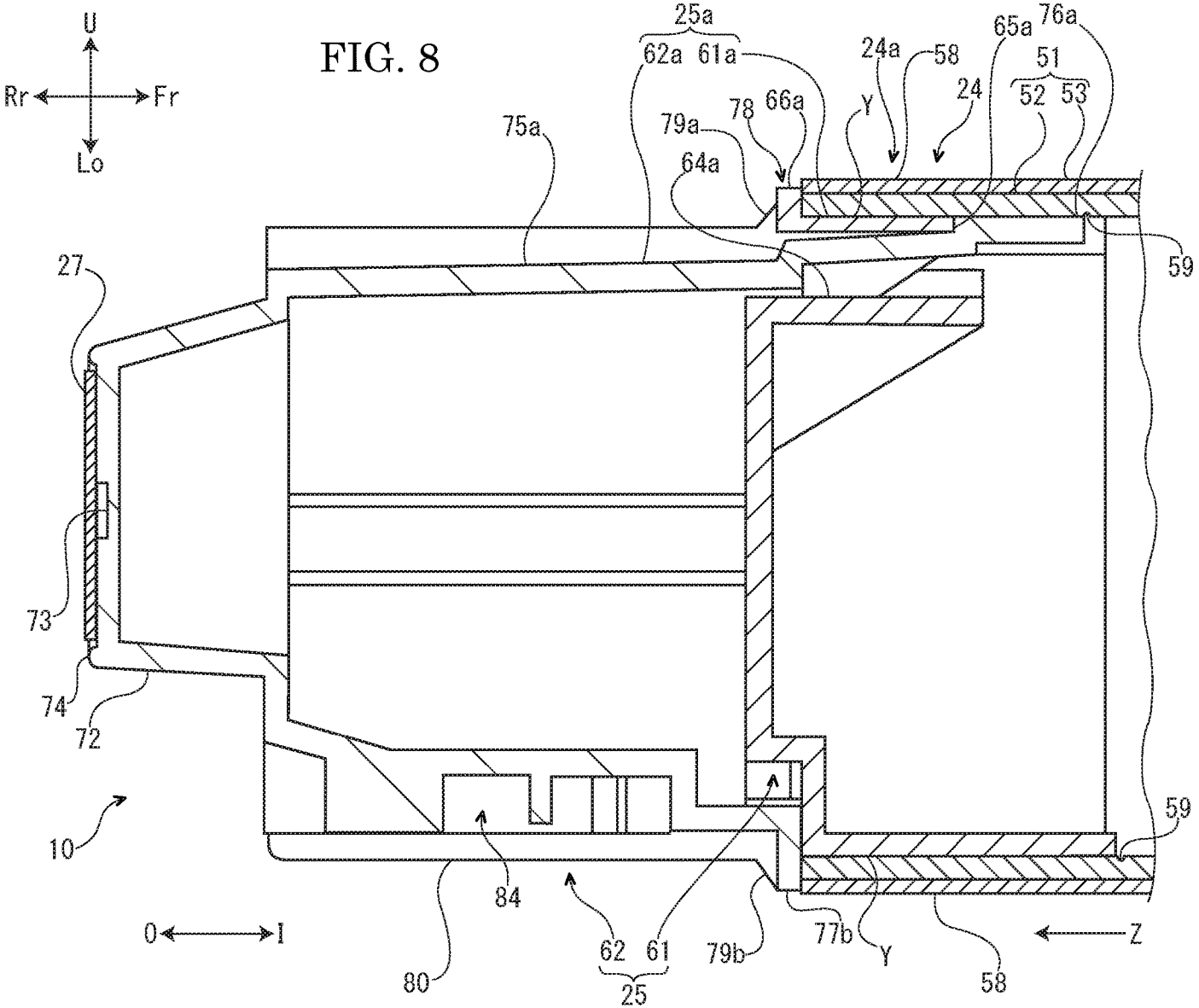
FIG. 8 is a sectional view showing the case, the cover and the IC tag according to the embodiment of the present disclosure.
Figure 9:
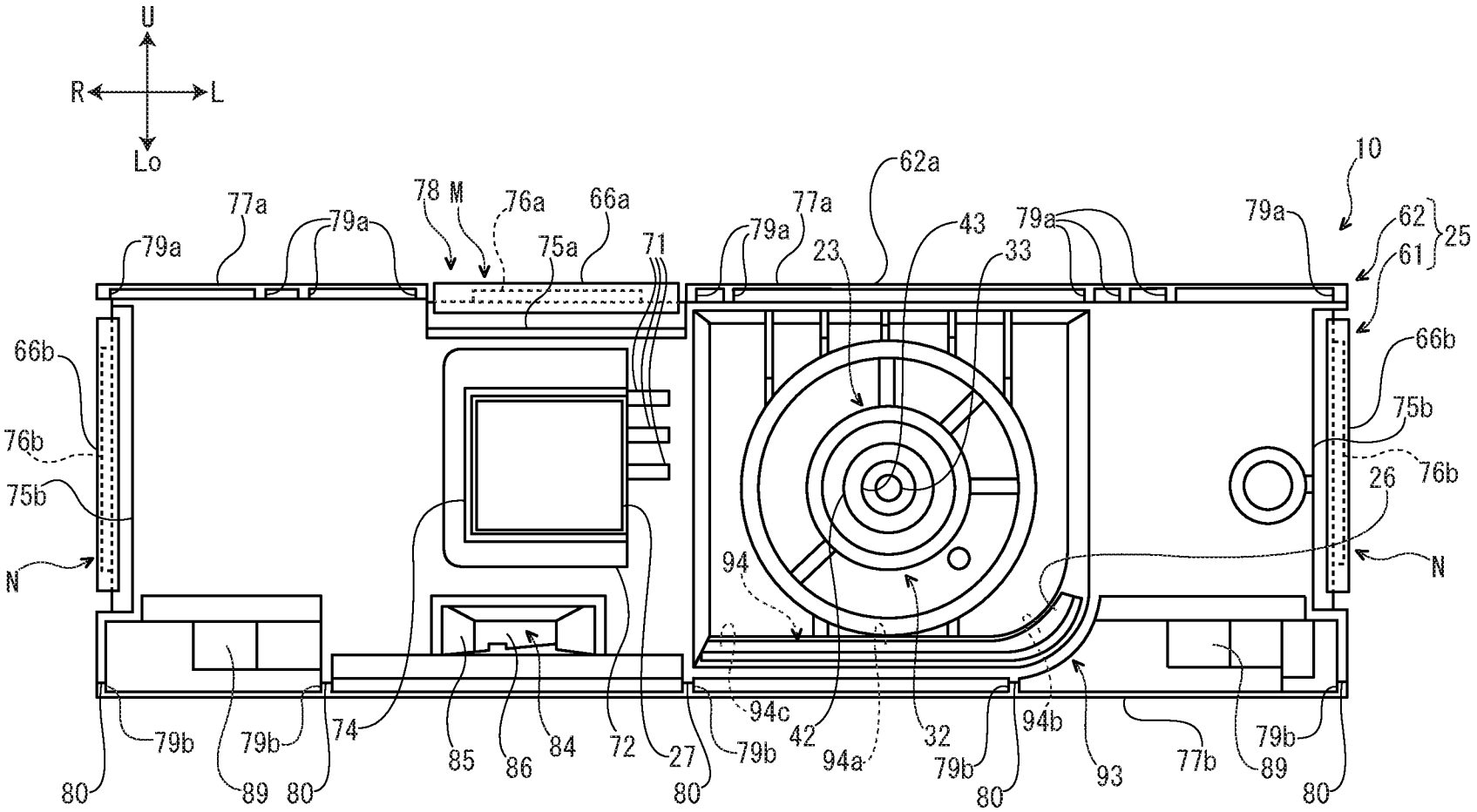
FIG. 9 is a back view showing the ink container according to the embodiment of the present disclosure.

With reference to FIG. 8 and FIG. 9, on the upper face of the outer cover part 62, a recess 75*a* is provided above the IC tag 27 when viewed from the rear side (the outside in the front-and-rear direction). The recess 75*a* has a width in the left-and-right direction wider than a width in the left-and-right direction of the pedestal part 72. On the left face and the right face of the outer cover part 62, recesses 75*b* are provided. Each recess 75*b* has a width in the upper-and-lower direction wider than a width in the upper-and-lower direction of the pedestal part 72.

With reference to FIG. 6, FIG. 8 and FIG. 9, on an upper portion of the front face (the face at the inside in the front-and-rear direction) of the outer cover part 62, a hook 76*a* (an example of a second fitting part) is protruded above the IC tag 27 when viewed from the rear side (the outside in the front-and-rear direction). The hook 76*a* penetrates through the through hole 64*a* of the inner cover part 61 and fitted into the fitting groove 65*a* of the inner cover part 61.

With reference to FIG. 6 and FIG. 7, on both side portions in the left-and-right direction of the front face of the outer cover part 62, hooks 76*b* (an example of the second fitting part) are protruded. The hooks 76*b* penetrate through the through holes 64*b* of the inner cover part 61 and fitted into the fitting grooves 65*b* of the inner cover part 61.

With reference to FIG. 4 and FIG. 6, on a front end portion (an end portion at the inside in the front-and-rear direction) of the upper face of the outer cover part 62, second ribs 77*a* are protruded. The second ribs 77*a* are separated by the recess 75*a*. Each second rib 77*a* extends along the left-and-right direction. The second ribs 77*a* are arranged on a linear line with the first rib 66*a* of the inner cover part 61.

With reference to FIG. 7, on a front end portion (an end portion at the inside in the front-and-rear direction) of the lower face of the outer cover part 62, a second rib 77*b* is protruded. The second rib 77*b* extends along the left-and-right direction. The second rib 77*b* continuously extends from a left end portion to a right end portion of the outer cover part 62.

With reference to FIG. 8 and FIG. 9, the second ribs 77*a* and 77*b* constitutes a protection rib 78 together with the first ribs 66*a* and 66*b*. The protection rib 78 covers, from the rear side (the outside in the front-and-rear direction), a bonded portion Y of the inside faces of the flaps 58 of the case 24 and the outer circumferential face 61*a* of the inner cover part 61. The protection rib 78 is protruded from each of four faces (an upper face, a lower face, a left face and a right face) of the cover 25, and the four faces constitute the outer circumferential face 25*a* of the cover 25. The protection rib 78 includes an area M whose position in the left-and-right direction is overlapped with a position in the left-and-right direction of the hook 76*a*. The area M is constituted by the first rib 66*a*. The protection rib 78 includes areas N whose positions in the upper-and-lower direction are overlapped with positions in the upper-and-lower direction of the hooks 76*b*. The areas N are constituted by the first ribs 66*b*.

With reference to FIG. 4 and FIG. 6, on the upper face of the outer cover part 62, a plurality of reinforcement ribs 79*a* is protruded at the rear side (the outside in the front-and-rear direction) of the second ribs 77*a*. The reinforcement ribs 79*a* are formed continuously with the second ribs 77*a*. A protruded height of each reinforcement rib 79*a* with respect to the upper face of the outer cover part 62 is increased from the rear side (the outside in the front-and-rear direction) to the front side (the inside in the front-and-rear direction). The reinforcement ribs 79*a* are provided at intervals in the left-and-right direction.

With reference to FIG. 7, on the lower face of the outer cover part 62, a plurality of reinforcement ribs 79*b* is protruded at the rear side (the outside in the front-and-rear direction) of the second rib 77*b*. The reinforcement ribs 79*b* are formed continuously with the second rib 77*b*. A protruded height of each reinforcement rib 79*b* with respect to the lower face of the outer cover part 62 is increased from the rear side (the outside in the front-and-rear direction) to the front side (the inside in the front-and-rear direction). The reinforcement ribs 79*b* are provided at intervals in the left-and-right direction.

On the lower face of the outer cover part 62, a plurality of extension ribs 80 is protruded at the rear side (the outside in the front-and-rear direction) of the reinforcement ribs 79*b*. The extension ribs 80 are formed continuously with the reinforcement ribs 79*b*. Each extension rib 80 extends along the front-and-rear direction.

Figure 10:
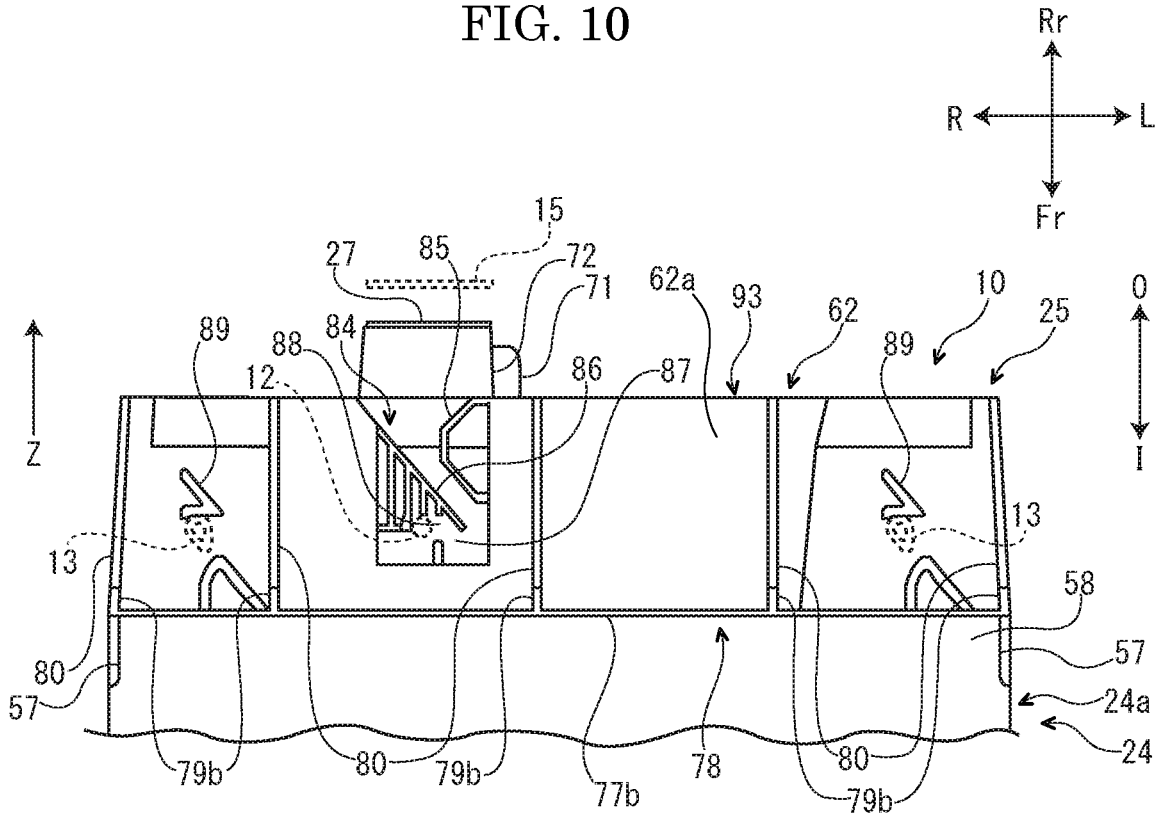
FIG. 10 is a bottom view showing the rear portion of the ink container according to the embodiment of the present disclosure.

With reference to FIG. 9 and FIG. 10, on the lower face of the outer cover part 62, a groove part 84 is provided below the IC tag 27 when viewed from the rear side (the outside in the front-and-rear direction). The groove part 84 has a first path 85, a second path 86 provided at the front side of the first path 85 and a third path 87 provided at the front side of the second path 86. The first path 85 is gradually narrowed from the rear side to the front side. The second path 86 is inclined to the left side from the rear side to the front side. The third path 87 extends along the left-and-right direction. The third path 87 has an engagement groove 88. On the lower face of the outer cover part 62, engagement ribs 89 are provided at both sides in the left-and-right direction of the groove part 84.

With reference to FIG. 5, on the front face (the face at the inside in the front-and-rear direction) of the outer cover part 62, a cylindrical holding tube 91 is provided. Into the holding tube 91, the outer cylindrical part 40 of the cap 32 of the spout 23 is fitted. Thereby, the spout 23 is held by the holding tube 91.

With reference to FIG. 5, FIG. 6 and FIG. 9, at a left side portion of the outer cover part 62, a frame part 93 is provided at the rear side (the outside in the front-and-rear direction) of the holding tube 91. The frame part 93 has a square frame shape. The frame part 93 covers an outer circumference of the discharge port 43 of the spout 23. The frame part 93 is opened to the rear side (the outside in the front-and-rear direction).

A bottom face 94 of the frame part 93 of the outer cover part 62 is inclined downward from the front side (the inside in the front-and-rear direction) to the rear side (the outside in the front-and-rear direction). The bottom face 94 of the frame part 93 includes a center portion 94*a* positioned below the discharge port 43 of the spout 23 when viewed from the rear side (the outside in the front-and-rear direction) and both corner portions 94*b* and 94*c* positioned at both sides in the left-and-right direction of the center portion 94*a*. The center portion 94*a* is formed to be flat. Both the corner portions 94*b* and 94*c* include the outer corner portion 94*b* positioned at the left side (the outside in the left-and-right direction) of the center portion 94*a* and the inner corner portion 94*c* positioned at the right side (the inside in the left-and-right direction) of the center portion 94*a*. The outer corner portion 94*b* is curved upward to the left side (the side separate from the center portion 94*a*) when viewed from the rear side (the outside in the front-and-rear direction). The inner corner portion 94*c* is formed to be flat.

Next, the liquid absorbing sheet 26 of each ink container 10 will be described.

With reference to FIG. 5, FIG. 6 and FIG. 9, the liquid absorbing sheet 26 of each ink container 10 is formed by non-woven fabric containing polyester fiber, for example. The liquid absorbing sheet 26 has a sheet shape, and has flexibility. The liquid absorbing sheet 26 is adhered on the center portion 94*a* and both the corner portions 94*b* and 94*c* of the bottom face 94 of the frame part 93 of the outer cover part 62.

Next, the IC tag 27 of each ink container 10 will be described.

With reference to FIG. 5, FIG. 6 and FIG. 9, the IC tag 27 of each ink container 10 has a square plate shape. The IC tag 27 is bonded to the rear face (the face at the outside in the front-and-rear direction) of the pedestal part 72 of the outer cover part 62 and fixed thereto. The IC tag 27 is positioned at a rear end portion (an end portion at the outside in the front-and-rear direction) of each ink container 10.

In the image forming apparatus 1 having the above described configuration, when each ink container 10 is attached to the corresponding attachment part 9, the supply port 16 of the attachment part 9 is connected to the cap 32 of the spout 23 and the needle 17 of the attachment part 9 presses the first valve body 33 of the spout 23. Consequently, the first valve body 33 of the spout 23 is moved from the first closing position (refer to the dotted line in FIG. 5) to the first opening position (refer to the solid line in FIG. 5) against biasing force of the first spring 45 so that the discharge port 43 of the spout 23 is opened.

When the discharge port 43 of the spout 23 is thus opened, suction force of a pump (not shown) connected to the supply port 16 of the attachment part 9 acts on the second valve body 35 of the spout 23. Consequently, the second valve body 35 of the spout 23 is moved from the second closing position (refer to the dotted line in FIG. 5) to the second opening position (refer to the solid line in FIG. 5) against biasing force of the second spring 49 so that the communication port 47 of the spout 23 is opened.

When the communication port 47 of the spout 23 is thus opened, the ink stored in the ink pack 22 is flowed in the discharge cylindrical part 42 of the cap 32 through the communication port 47 of the spout 23. The ink flowed in the discharge cylindrical part 42 of the cap 32 is discharged through the discharge port 43 of the spout 23 outside the ink container 10 and supplied to the supply port 16 of the attachment part 9. The ink supplied to the supply port 16 of the attachment part 9 is supplied to the recording head 7 of the line head 6 through the pipe 11.

Additionally, when each ink container 10 is attached to the corresponding attachment part 9 in the above described manner, the IC tag 27 of the ink container 10 faces the communication board 15 of the attachment part 9 via a space (refer to FIG. 10). This makes it possible to perform radio communication using radio frequency identification (RFID) between the IC tag 27 and the communication board 15.

Additionally, when each ink container 10 is attached to the corresponding attachment part 9 in the above described manner, the pin 12 of the attachment part 9 is engaged with the engagement groove 88 of the groove part 84 of the ink container 10 (refer to FIG. 10). This allows each ink container 10 to be positioned to the corresponding attachment part 9. When each ink container 10 is attached to the corresponding attachment part 9 in the above described manner, the bosses 13 of the attachment part 9 are engaged with the engagement ribs 89 of the ink container 10 (refer to FIG. 10). This inhibits a tilt of each ink container 10 in the left-and-right direction with respect to the corresponding attachment part 9.

By the way, in the present embodiment, the outer circumferential face 61*a* of the inner cover part 61 is bonded to the inside faces of the flaps 58 of the case 24. If such a configuration is applied, when each ink container 10 is attached to the corresponding attachment part 9, there is a fear that each flap 58 touches a part of the attachment part 9 and is rolled up, and the bonded portion Y of the inside faces of the flaps 58 and the outer circumferential face 61*a* of the inner cover part 61 (hereinafter, simply called "the bonded portion Y") may be separated.

Then, on the outer circumferential face 25*a* of the cover 25, the protection rib 78 which covers the bonded portion Y from the rear side (the outside in the front-and-rear direction) is protruded. By applying such a configuration, when each ink container 10 is attached to the corresponding attachment part 9, each flap 58 is prevented from touching a part of the attachment part 9 so that it becomes possible to inhibit each flap 58 from being rolled up. Accordingly, it becomes possible to inhibit the bonded portion Y from being separated.

On the other hand, when the protection rib 78 is protruded from the outer circumferential face 25*a* of the cover 25 as described above, when each ink container 10 is attached to the corresponding attachment part 9, there is a fear that the protection rib 78 is caught by a part of the attachment part 9 and it may be difficult to attach the ink container 10 to the corresponding attachment part 9.

Then, on the upper face and the lower face of the outer cover part 62, the plurality of reinforcement ribs 79*a* and the plurality of reinforcement ribs 79*b* which are formed continuously with the second ribs 77*a* and 77*b* are protruded at the rear side (the outside in the front- and rear direction) of the second ribs 77*a* and 77*b*, respectively. Additionally, a protruded height of each of the reinforcement ribs 79*a* and 79*b* is increased from the rear side (the outside in the front-and-rear direction) to the front side (the inside in the front-and-rear direction). By applying such a configuration, when each ink container 10 is attached to the corresponding attachment part 9, it becomes possible to inhibit the protection rib 78 from being caught by a part of the attachment part 9 so that the ink container 10 can be attached to the corresponding attachment part 9 smoothly.

Additionally, each of the second ribs 77*a* and 77*b* extends in the left-and-right direction (the direction perpendicular to the front-and-rear direction), and the plurality of reinforcement ribs 79*a* and the plurality of reinforcement ribs 79*b* are provided at intervals in the left-and-right direction. By applying such a configuration, when each ink container 10 is attached to the corresponding attachment part 9, it becomes possible to surely inhibit the protection rib 78 from being caught by a part of the attachment part 9.

Additionally, on the lower face of the outer cover part 62, the plurality of extension ribs 80 formed continuously with the plurality of reinforcement ribs 79*b* is protruded at the rear side (the outside in the front-and-rear direction) of the reinforcement ribs 79*b*, and each extension rib 80 extends along the front-and-rear direction. By applying such a configuration, when each ink container 10 is attached to the corresponding attachment part 9, it becomes possible to inhibit the reinforcement ribs 79*b* from being caught by a part of the attachment part 9 so that each ink container 10 can be attached to the corresponding attachment part 9 more smoothly.

Additionally, the protection rib 78 is constituted by the first ribs 66*a* and 66*b* protruded on the outer circumferential face 61*a* of the inner cover part 61 and the second ribs 77*a* and 77*b* protruded on the outer circumferential face 62*a* of the outer cover part 62. By applying such a configuration, it becomes possible to provide the second ribs 77*a* and 77*b* at a portion where it is difficult to provide the first ribs 66*a* and 66*b* and to provide the first ribs 66*a* and 66*b* at a portion where it is difficult to provide the second ribs 77*a* and 77*b*. As a result, it becomes possible to provide the protection rib 78 within a large range as much as possible so that when each ink container 10 is attached to the corresponding attachment part 9, it becomes possible to surely prevent each flap 58 from touching a part of the attachment part 9.

Additionally, the protection rib 78 includes areas M and N whose positions in the left-and-right direction or the upper-and-lower direction (the direction perpendicular to the front-and-rear direction) are overlapped with positions in the left-and-right direction or the upper-and-lower direction of the hooks 76*a* and 76*b*, and the areas M and N are constituted by the first ribs 66*a* and 66*b*, respectively. By applying such a configuration, it becomes possible to inhibit structural complication of a die for manufacturing the outer cover part 62 and to prevent increase in a manufacturing cost of the outer cover part 62.

Additionally, on the rear face (the face at the outside in the front-and-rear direction) of the inner cover part 61, the through holes 64*a* and 64*b* are provided, and the hooks 76*a* and 76*b* penetrate through the through holes 64*a* and 64*b*, respectively. By applying such a configuration, it becomes possible to insert the hooks 76*a* and 76*b* in the front side (the inside in the front-and-rear direction) of the rear face of the inner cover part 61 and to fit them into the fitting grooves 65*a* and 65*b*, respectively.

Additionally, the first rib 66*a* and the second ribs 77*a* extend along the left-and-right direction, and the second ribs 77*a* are arranged on a linear line with the first rib 66*a*. By applying such a configuration, it becomes possible to inhibit generation of a step between the first rib 66*a* and the second ribs 77*b*. Then, when each ink container 10 is attached to the corresponding attachment part 9, it becomes possible to avoid a case where the above step may be caught by a part of the attachment part 9.

Additionally, the case 24 has a square tube shape, the cover 25 has a square frame shape, the four faces constituting the outer circumferential face 25*a* of the cover 25 are bonded to the rear end portion 24*a* of the case 24 and the protection rib 78 is protruded from each of the four faces constituting the outer circumferential face 25*a* of the cover 25. By applying such a configuration, when each ink container 10 is attached to the corresponding attachment part 9, it becomes possible to inhibit each flap 58 from being rolled up more effectively.

Additionally, the image forming apparatus 1 includes the ink containers 10 and the attachment parts 9 to which the respective ink containers 10 are detachably attached. By applying such a configuration, it becomes possible to provide the image forming apparatus 1 capable of inhibiting the bonded portion Y from being separated.

By the way, if an operator who replaces each ink container 10 brings the IC tag 27 into contact with the image forming apparatus 1 or an apparatus disposed around it accidentally, the IC tag 27 may be damaged.

Then, on the upper face of the outer cover part 62, the recess 75*a* is provided above the IC tag 27 when viewed from the rear side (the outside in the front-and-rear direction). It is highly possible that the operator who replaces each ink container 10 places his finger to the recess 75*a* in order to prevent slipping of his hand. When the operator places his finger to the recess 75*a*, a possibility that the IC tag 27 positioned below the recess 75*a* when viewed from the rear side is covered with his hand is increased so that it becomes possible to reduce the possibility that the IC tag 27 may be damaged.

Additionally, on the upper face of the inner cover part 61, the fitting groove 65*a* is provided, and on the front face (the face at the inside in the front-and-rear direction) of the outer cover part 62, the hook 76*a* engaged with the fitting groove 65*a* is provided above the IC tag 27 when viewed from the rear side (the outside in the front-and-rear direction). By applying such a configuration, it becomes possible to improve a positional precision of the IC tag 27 with respect to the inner cover part 61 in the left-and-right direction.

Additionally, on the rear face (the face at the outside in the front-and-rear direction) of the outer cover part 62, the connection ribs 71*a* are protruded, and the left side face of the pedestal part 72 is connected to the connection ribs 71. By applying such a configuration, it becomes possible to heighten strength of the pedestal part 72.

Additionally, a width in the left-and-right direction of the recess 75*a* is wider than a width in the left-and-right direction of the pedestal part 72. By applying such a configuration, it becomes possible to keep the width in the left-and-right direction of the recess 75*a* sufficient so that the operator easily places his finger to the recess 75*a*.

Additionally, on the lower face of the outer cover part 62, the groove part 84 is provided below the IC tag 27 when viewed from the rear side (the outside in the front-and-rear direction). By applying such a configuration, it become possible to confirm the position of the IC tag 27 using the groove part 84 as a mark.

Additionally, the image forming apparatus 1 includes the ink containers 10 and the attachment parts 9 to which the respective ink containers 10 are detachably attached. By applying such a configuration, it becomes possible to provide the image forming apparatus 1 capable of reducing a possibility that the IC tag 27 may be damaged.

Additionally, on the lower face of the outer cover part 62, the groove part 84 is provided below the IC tag 27 when viewed from the rear side (the outside in the front-and-rear direction). When each ink container 10 is attached to the corresponding attachment part 9, the pin 12 of the attachment part 9 is engaged with the engagement groove 88 of the groove part 84 so that the ink container 10 is positioned with respect to the attachment part 9. By applying such a configuration, it becomes possible to improve a positional precision of the IC tag 27 with respect to the attachment part 9 in the left-and-right direction. Therefore, it becomes possible to arrange the IC tag 27 at a suitable position with respect to the communication board 15 provided in the attachment part 9 and to inhibit communication error between the communication board 15 and the IC tag 27.

By the way, if an entire of the bottom face 94 of the frame part 93 of the outer cover part 62 is formed to be flat, the liquid absorbing sheet 26 may be bonded to the bottom face 94 of the frame part 93 in a flat plate shape. Then, the ink absorbed in the liquid absorbing sheet 26 may be easily leaked from both end portions in the left-and-right direction of the liquid absorbing sheet 26, and the leaked ink may contaminate the ink container 10 and its periphery.

Then, the outer corner portion 94*b* of the bottom face 94 of the frame part 93 is curved upward to the left side (the side separate from the center portion 94*a*) when viewed from the rear side (the outside in the front-and-rear direction). By applying such a configuration, the left end portion of the liquid absorbing sheet 26 is bonded to the bottom face 94 of the frame part 93 in a curved state. Then, it becomes possible to inhibit the ink absorbed in the liquid absorbing sheet 26 from being leaked from the left end portion of the liquid absorbing sheet 26 and to inhibit the ink container 10 and its periphery from being contaminated with the leaked ink.

Additionally, the center portion 94*a* of the bottom face 94 of the frame part 93 is formed to be flat. By applying such a configuration, it becomes possible to inhibit the ink from being gathered on the center portion in the left-and-right direction of the liquid absorbing sheet 26 excessively.

Additionally, the outer corner portion 94*b* of the bottom face 94 of the frame part 93 is curved upward when viewed from the rear side (the outside in the front-and-rear direction) and the inner corner portion 94*c* of the bottom face 94 of the frame part 93 is formed to be flat. By applying such a configuration, compared with a case where both the corner portions 94*b* and 94*c* of the bottom face 94 of the frame part 93 are curved upward, it becomes possible to increase a surface area of a flat shaped portion of the bottom face 94 of the frame part 93.

Additionally, the frame part 93 is opened to the rear side (the outside in the front-and-rear direction), and the bottom face 94 of the frame part 93 is inclined downward from the front side (the inside in the front-and-rear direction) to the rear side (the outside in the front-and-rear direction). If such a configuration is applied, because the ink leaked from both the end portions in the left-and-right direction of the liquid absorbing sheet 26 is easily leaked through the bottom face 94 of the frame part 93 outside the cover 25, using the above described configuration provides a high advantage for inhibiting the ink leakage.

Additionally, the liquid absorbing sheet 26 is bonded to the center portion 94*a* and both the corner portions 94*b* and 94*c* of the bottom face 94 of the frame part 93. By applying such a configuration, it becomes possible to make the liquid absorbing sheet 26 absorb the ink leaked from the discharge port 43 of the spout 23 surely.

Additionally, the image forming apparatus 1 includes the ink containers 10 and the attachment parts 9 to which the respective ink containers 10 are attached. By applying such a configuration, it becomes possible to provide the image forming apparatus 1 capable of inhibiting the ink containers 10 and their peripheries from being contaminated with the ink leaked from the liquid absorbing sheet 26.

By the way, in order to improve workability of assembling work of the ink container 10, it is desirable that in a state where all of a step for forming the case 24 in a square cylindrical shape, a step for welding the spout 23 to the ink pack 22 and a step for fixing the spout 23 to the cover 25 are completed, the rear end portion 24*a* of the case 24 formed in a square cylindrical shape be bonded to the outer circumferential face 61*a* of the inner cover part 61. However, when the above assembling step is applied, if the inner cover part 61 and the case 24 have a large dimension error, the rear end portion 24*a* of the case 24 may not be bonded to the four faces constituting the outer circumferential face 61*a* of the inner cover part 61 surely.

Then, at the four corners of the rear end portion 24*a* of the case 24, the slits 57 are provided. By applying such a configuration, it becomes possible to fold the rear end portion 24*a* of the case 24 formed in a square cylindrical shape and to surely bond them to the four faces constituting the outer circumferential face 61*a* of the inner cover part 61. This makes it possible to apply the above assembling step and to improve the workability of the assembling work of the ink container 10.

Additionally, in the rear end portion 24*a* of the case 24, the four flaps 58 are provided between the adjacent slits 57, and at the front end portion (the end portion at the inside in the front-and-rear direction) of each flap 58, the folding line 59 is provided along the left-and-right direction or the upper-and-lower direction (perpendicular to the front-and-rear direction). By applying such a configuration, it becomes possible to fold each flap 58 along the folding line 59 easily.

Additionally, on the lower face of the inner cover part 61, the depressions 67 are provided, and on the front face (the face at the inside in the front-and-rear direction) of the outer cover part 62, the protruding pieces 69 engaged with the depressions 67 are provided. By applying such a configuration, it becomes possible to bond the protruding pieces 69 to the inside faces of the flaps 58 together with the lower face of the inner cover part 61 so that bonding strength of the case 24 to the cover 25 can be heightened.

Additionally, on each depression 67 of the inner cover part 61, the fitting projection 68 is protruded, and in each protruding piece 69 of the outer cover part 62, the fitting hole 70 fitted to the fitting projection 68 is provided. By applying such a configuration, it becomes possible to improve fixing strength of the inner cover part 61 to the outer cover part 62.

Additionally, the case 24 is formed by a sheet of paper 51. By applying such a configuration, it becomes possible to make the structure of the case 24 simple and to reduce manufacturing cost of the case 24.

Additionally, the paper 51 includes the corrugated cardboard layer 52 and the coated cardboard layer 53 covering the surface of the corrugated cardboard layer 52. By applying such a configuration, compared with a case where the paper 51 is formed by the corrugated cardboard layer 52 only, it becomes possible to enhance designability of the case 24.

Additionally, the image forming apparatus 1 includes the ink containers 10 and the attachment parts 9 to which the respective ink containers 10 are detachably attached. By applying such a configuration, it becomes possible to provide the image forming apparatus 1 capable of bonding the rear end portion 24*a* of the case 24 to the cover 25 surely.

In the present embodiment, the inner cover part 61 and the outer cover part 62 of the cover 25 are provided separately. On the other hand, in another embodiment, the inner cover part 61 and the outer cover part 62 of the cover 25 may be formed integrally.

In the present embodiment, the first ribs 66*a* and 66*b* of the inner cover part 61 and the second ribs 77*a* and 77*b* of the outer cover part 62 constitute the protection rib 78. On the other hand, in another embodiment, the protection rib 78 may be constituted by the rib of the inner cover part 61 only or the rib of the outer cover part 62 only.

In the present embodiment, the outer corner portion 94*b* of the bottom face 94 of the frame part 93 is curved upward when viewed from the rear side (the outside in the front-and-rear direction) and the inner corner portion 94*c* of the bottom face 94 of the frame part 93 is formed to be flat. On the other hand, in another embodiment, both the corner portions 94*b* and 94*c* of the bottom face 94 of the frame part 93 may be curved upward when viewed from the rear side (the outside in the front-and-rear direction).

In the present embodiment, the first fitting part is constituted by the fitting grooves 65*a* and 65*b*, and the second fitting part is constituted by the hooks 76*a* and 76*b*. On the other hand, in another embodiment, the first fitting part may be constituted by the hooks 76*a* and 76*b*, and the second fitting part may be constituted by the fitting grooves 65*a* and 65*b*.

In the present embodiment, a color printer is employed as an example of the image forming apparatus 1. On the other hand, in another embodiment, a monochrome printer, a copying machine, a facsimile, a multifunctional peripheral (an image forming apparatus multiply including a printing function, a copying function, a facsimile function and the others) may be employed as the image forming apparatus 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An ink container comprising:

an ink pack configured to store ink;

a paper case configured to store the ink pack and to have a shape elongated in one direction; and a cover bonded to an end portion in the one direction of the case, wherein a protection rib is protruded on an outer circumferential face of the cover, the protection rib covers, from an outside in the one direction, a bonded portion of the end portion of the case and the cover, at least one reinforcement rib is further protruded on the outer circumferential face of the cover at the outside in the one direction of the protection rib and formed continuously with the protection rib, and a protruded height of the at least one reinforcement rib with respect to the outer circumferential face of the cover is increased from the outside to an inside in the one direction.

2. The ink container according to claim 1, wherein the protection rib extends in a direction perpendicular to the one direction, and the at least one reinforcement rib includes a plurality of reinforcement ribs provided at an interval in the direction perpendicular to the one direction.

3. The ink container according to claim 1, wherein at least one extension rib is protruded on the outer circumferential face of the cover at the outside in the one direction of the at least one reinforcement rib and formed continuously with the at least one reinforcement rib, and the at least one extension rib extends along the one direction.

4. The ink container according to claim 1, wherein the case has a square tube shape, the cover has a square frame shape, four faces constituting the outer circumferential face of the cover are bonded to the end portion of the case, and the protection rib is protruded from each of the four faces constituting the outer circumferential face of the cover.

5. The ink container according to claim 1, wherein the case is formed by a sheet of paper.

6. The ink container according to claim 1, further comprising an IC tag fixed to an outside face in the one direction of the cover.

7. An image forming apparatus comprising:
the ink container according to claim 1; and
an attachment part to which the ink container is detachably attached.

8. An ink container comprising:
an ink pack configured to store ink;
a paper case configured to store the ink pack and to have a shape elongated in one direction; and
a cover bonded to an end portion in the one direction of the case,
wherein a protection rib is protruded on an outer circumferential face of the cover, and
the protection rib covers, from an outside in the one direction, a bonded portion of the end portion of the case and the cover,
wherein the cover includes:
an inner cover part bonded to the end portion of the case; and
an outer cover part attached to the inner cover part and configured to cover the outside in the one direction of the inner cover part,
wherein the protection rib is constituted by a first rib protruded on an outer circumferential face of the inner cover part and a second rib protruded on an outer circumferential face of the outer cover part,
wherein a first fitting part is provided on the outer circumferential face of the inner cover part,
a second fitting part fitted to the first fitting part is provided on an inside face in the one direction of the outer cover part, and
the protection rib includes an area whose position in a direction perpendicular to the one direction is overlapped with a position in the direction perpendicular to the one direction of the second fitting part, and the area is constituted by the first rib.

9. The ink container according to claim 8,
wherein a through hole is provided on an outside face in the one direction of the inner cover part, and
the second fitting part penetrates through the through hole.

10. The ink container according to claim 8,
wherein the first rib and the second rib extend along a direction perpendicular to the one direction, and
the second rib is arranged on a linear line with the first rib.

11. An ink container comprising:
an ink pack configured to store ink;
a paper case configured to store the ink pack and to have a shape elongated in one direction;
a cover bonded to an end portion in the one direction of the case; and
a spout attached to an end portion in the one direction of the ink pack,
wherein a protection rib is protruded on an outer circumferential face of the cover, and
the protection rib covers, from an outside in the one direction, a bonded portion of the end portion of the case and the cover,
wherein the spout includes a discharge port for the ink, and
the cover includes a frame part configured to cover an outer circumference of the discharge port and a liquid absorbing sheet adhered on a bottom face of the frame part.

12. An ink container comprising:
an ink pack configured to store ink;
a paper case configured to store the ink pack and to have a shape elongated in one direction; and
a cover bonded to an end portion in the one direction of the case,
wherein a protection rib is protruded on an outer circumferential face of the cover,
the protection rib covers, from an outside in the one direction, a bonded portion of the end portion of the case and the cover,
wherein the cover includes:
an inner cover part bonded to the end portion of the case; and
an outer cover part attached to the inner cover part and configured to cover the outside in the one direction of the inner cover part,
wherein the protection rib is constituted by a first rib protruded on an outer circumferential face of the inner cover part and a second rib protruded on an outer circumferential face of the outer cover part,
the first rib and the second rib extend along a direction perpendicular to the one direction, and
the second rib is arranged on a linear line with the first rib when the outer cover is attached to the inner cover.

13. The ink container according to claim 12,
wherein the protection rib is constituted by a plurality of the first rib and a plurality of the second ribs.

14. The ink container according to claim 12,
wherein at least two of the second ribs are separated by a recess, and
when the outer cover is attached to the inner cover, the first rib is arranged in the recess and the at least two of the second ribs are arranged on a linear line with the first rib.

* * * * *